US007389855B2

(12) United States Patent
Rexroad

(10) Patent No.: US 7,389,855 B2
(45) Date of Patent: Jun. 24, 2008

(54) FREE STANDING PERIMETER NET SYSTEM

(76) Inventor: John Rexroad, 500 Main St., P.O. Box 1019, Deep River, CT (US) 06417

( * ) Notice: Subject to any disclaimer, the term of this patent is extended or adjusted under 35 U.S.C. 154(b) by 162 days.

(21) Appl. No.: 11/089,686

(22) Filed: Mar. 24, 2005

(65) Prior Publication Data

US 2006/0213724 A1 Sep. 28, 2006

(51) Int. Cl.
*E04G 21/32* (2006.01)

(52) U.S. Cl. ..... 182/138; 182/137; 182/140; 182/82

(58) Field of Classification Search ..... 182/136–140, 182/82, 83; 482/27
See application file for complete search history.

(56) References Cited

U.S. PATENT DOCUMENTS 3,949,834 A * 4/1976 Nusbaum ..... 182/138
4,074,791 A * 2/1978 Inman ..... 182/138
4,119,176 A * 10/1978 Verdu ..... 182/138
4,732,234 A * 3/1988 Brickman ..... 182/138
4,823,418 A * 4/1989 Downs ..... 182/138
4,856,615 A * 8/1989 Nusbaum ..... 182/82
4,892,169 A * 1/1990 Duncan ..... 182/138
4,962,828 A * 10/1990 Duncan ..... 182/82
5,161,641 A * 11/1992 Nusbaum ..... 182/138
5,582,266 A * 12/1996 Rexroad et al. ..... 182/138
5,673,769 A * 10/1997 Rexroad et al. ..... 182/138
5,848,665 A * 12/1998 Rexroad et al. ..... 182/138

* cited by examiner

*Primary Examiner*—Brian E. Glessner
*Assistant Examiner*—Colleen M Quinn
(74) *Attorney, Agent, or Firm*—Venable, Campillo, Logan & Meaney, P.C.

(57) ABSTRACT

A free standing perimeter net system is disclosed. The perimeter net system is comprised of a support arm, a support cable, an uplift brace, at least one net system brace, a back plate, a pivot, a vertical support, a strut, and a pair of strut brackets. These components work together to allow a safety net system to easily be installed around a structure without directly attaching to the structure. The support arm rotates between an open and a closed position on the pivot. This configuration allows the net, which is attached to the support arm, to be deployed at various angles. When the support arm rotates, the uplift brace also adjusts and aids in securing the support arm and net in the desired position. The vertical support couples the net system to the building or structure via the back plate and strut. The net system braces are also attached to the vertical support and provide added rigidity to the net system.

10 Claims, 16 Drawing Sheets

FREE STANDING PERIMETER NET SYSTEM

BACKGROUND

The present invention relates generally to an apparatus used for maintaining a safe work environment, more particularly, to an apparatus that comprises a net system that maintains a safe work area for construction crews, members of the public, and property that are near a building undergoing construction or renovations. Specifically, the present invention utilizes a safety net system that is free standing and includes an adjustable support arm that can rotate between an open and closed position for maintenance on the net, protection of the net system in inclement weather, and added protection of the crew members, members of the public, and property.

A crew maintaining, renovating, or constructing a high-rise building or structure must deal with many hazards in the work environment. Members of the crew on the ground and in the air must be constantly aware of their surroundings to prevent injuries from falls or falling objects. Additionally, the public on the premises of a construction project must be aware of potentially hazardous situations, such as dropped objects falling from above that could cause bodily injury or property damage.

One way to ensure protection of the crew, public, and property is to install a safety net system that surrounds the perimeter of a building or structure near the area where objects may fall. However, it may be difficult to install a safety net system to a building or structure where there are no protrusions on the building, such as parapets, balconies, windows, or beams, from which a safety net system can be attached with a mounting bracket or clamp. The difficulty in installing the net system can result in a hazardous condition for the crew members, the public and property. Because a safety net system can be difficult or unfeasible to install on some buildings or structures, the crew may not take the time to install a safety net system causing the potential for serious injury or damage to result.

The present invention provides crew members with an easy and secure way to install a safety net system that is free standing, meaning that it does not require attachment to building or structure protrusions. The present invention is a perimeter net system that includes a vertical support, a support arm, an uplift brace, and at least one net system brace. Attached to the support arm is a net that catches falling objects when the support arm is in the open position and is repaired and protected against inclement weather conditions when the support arm is in the closed position. The vertical support of the perimeter net system attaches to the building or structure under construction and provides support to the support arm, uplift brace, and net system brace. The uplift brace is also connected to the support arm and adjusts as the support arm rotates. The uplift brace is secured when the support arm is at the desired angle. The net system braces are rigid and provide support to keep the net system from inadvertently shifting or moving.

Currently, there are devices that use nets attached to buildings or structures to protect people working on maintenance or construction crews, the members of the public, and property on the ground that could be damaged by falling objects. However, each of these devices suffers from several disadvantages. First, the devices can only be installed on buildings or structures with protrusions, such as balconies, beams, windows, or parapets. The current devices are not free standing. Second, the devices are difficult to assemble. The devices contain many parts and require a difficult multi-step process to install.

Presently, there is no net system that is free standing and easy to install. For the foregoing reasons, there is a need for a device that would allow construction crews to easily install a free standing net system around a building or structure.

SUMMARY

The present invention is directed to a device that satisfies the needs of providing a net system that is free standing, providing a net system that is easy to install, providing a net system that can be protected from inclement weather conditions, providing a net system that includes an adjustable support arm, and providing a net system that is quickly and easily positioned to protect people from falling objects.

A net system having features of the present invention comprises a support arm, a support cable, an uplift brace, at least one net system brace, a pivot, a back plate, a vertical support, a strut, a net, a first strut bracket, and a second strut bracket. The first end of the support arm is coupled to the support cable to aid in securing the support arm when it is in the open position. The opposite end of the support cable attaches to the front side of the back plate. Additional support is provided to the support arm by the uplift brace. The second end of the support arm is coupled to the pivot and rotates around the pivot between an open and closed position.

The upper end of the uplift brace is coupled along the length of the vertical support and the lower end of the uplift brace is coupled along the length of the support arm. The uplift brace adjusts as the support arm rotates between the open and closed positions. The net system brace provides support to the free standing net system. The top of the net system brace attaches along the length of the vertical support some distance below the uplift brace and the bottom of the net system brace attaches to the first strut bracket. The net system is secured to the building or structure via the back plate that is attached to the top of the vertical support. The bottom of the vertical support is attached to the second strut bracket. The pivot is coupled along the length of the vertical support a distance below said net system brace. The strut also provides support to the free standing net system and is adjustably coupled to the first and second strut bracket. The net has a first side that attaches to the first end of the support arm and the second side attaches along the length of the uplift brace so that the net is open when the support arm is in the open position.

It is an object of the present invention to provide a net system that is free standing.

It is a further object of the present invention to provide a net system that is easy to install.

It is a further object of the present invention to provide a net system that can be protected from inclement weather conditions.

It is a further object of the present invention to provide a net system that includes an adjustable support arm It is a further object of the present invention to provide a net system that is quickly and easily positioned to protect people.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C §112, paragraph 6 are sought to be invoked to define the invention (s), the claims will specifically state the phrases "means for" or "step for" and a function, without also reciting in such phrases any structure, material, or act in support of the function.

Moreover, even if the provisions of 35 U.S.C §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 1:
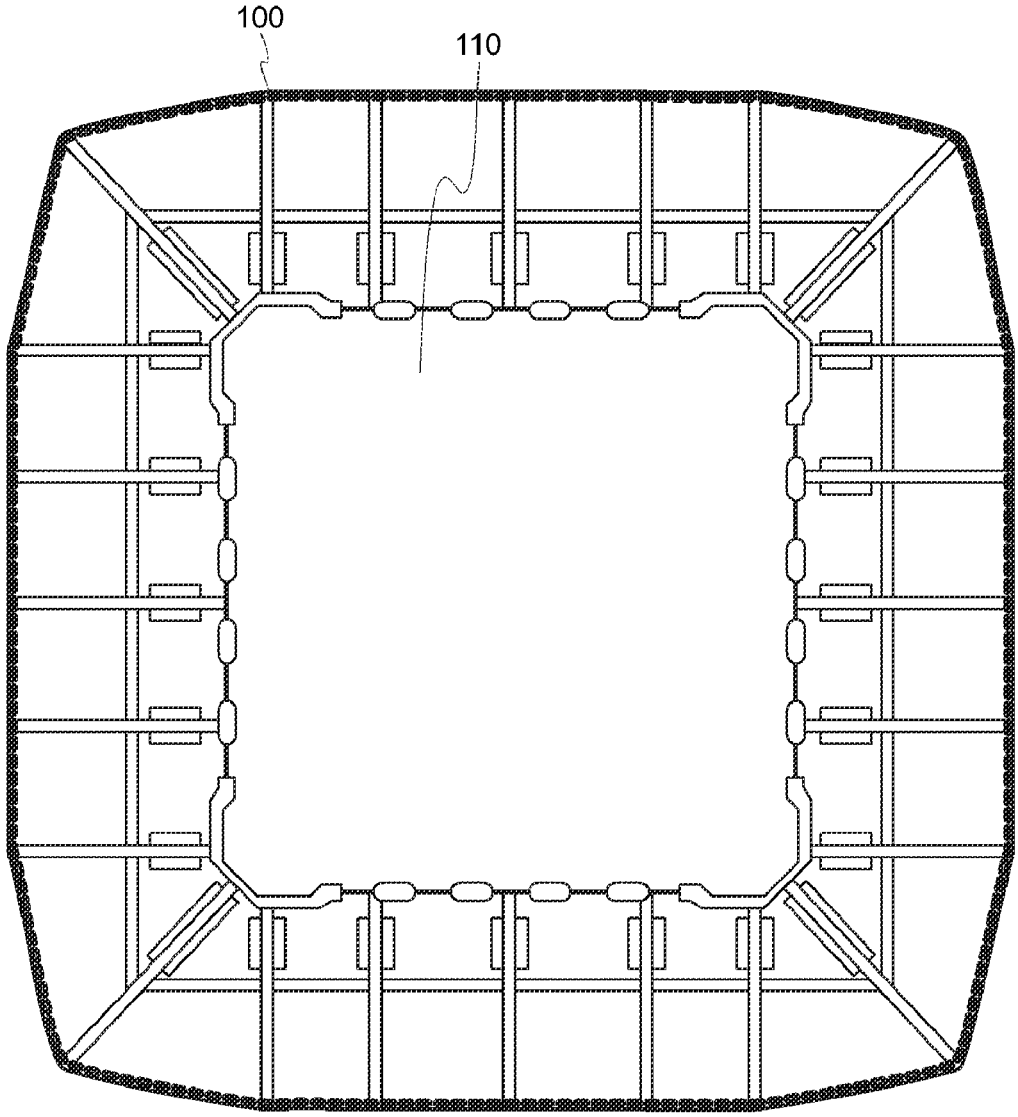
FIG. 1 shows a top view of multiple free standing perimeter net systems connected and in an open position around the perimeter of a building.
Figure 3:
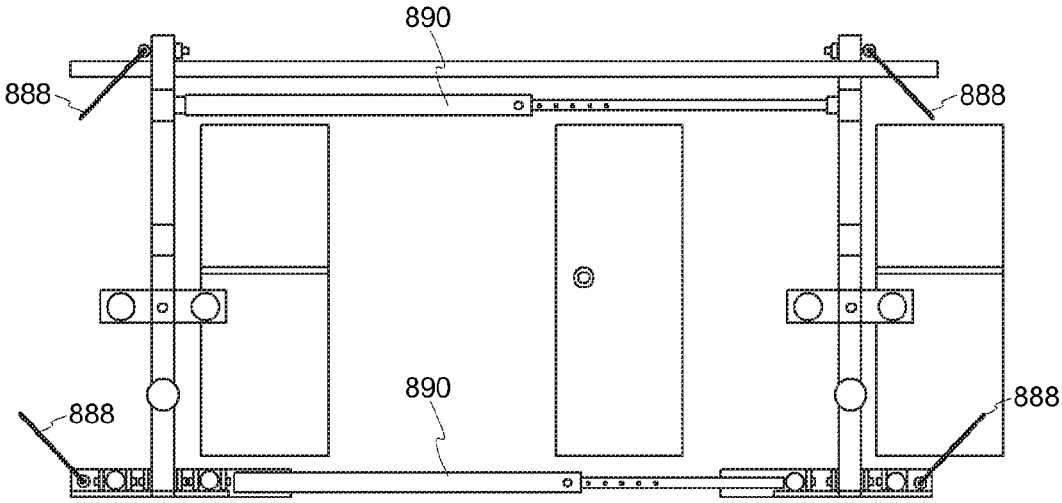
FIG. 3 shows a front view of two free standing perimeter net systems around a door and a window.

As shown in FIG. 1, an individual free standing perimeter net system 200 can be attached to other free standing perimeter net systems 200 with a set of tie cables 888 to provide a free standing safety net system 100 that encompasses the entire perimeter of a structure 110. FIG. 3 shows two (2) individual free standing perimeter net systems 200 attached along the wall of a structure with tie cables 888 and strut braces 890. The strut braces 890 provide support to the free standing perimeter net systems 200 when the support arm 300 is in position to protect people and property.

Figure 2:
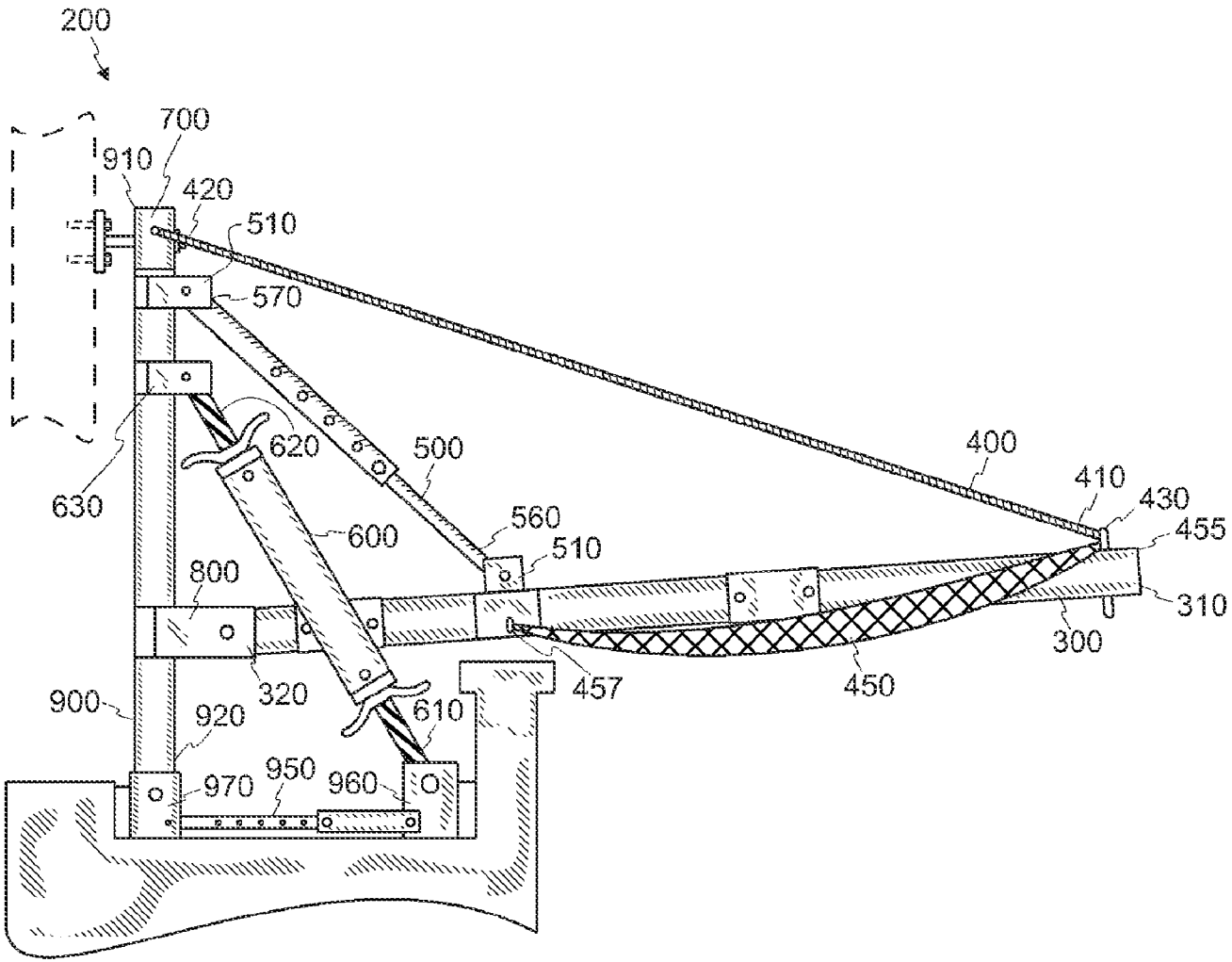
FIG. 2 shows a side view of a single free standing perimeter net system in an open position.

FIG. 2 shows a side view of an individual free standing perimeter net system 200. The preferred embodiment of the free standing perimeter net system 200 is comprised of a support arm 300, a support cable 400, an uplift brace 500, at least one net system brace 600, a back plate 700, a pivot 800, a vertical support 900, a strut 950, a net 450, a first strut bracket 960, and a second strut bracket 970. These components work together to create a free standing perimeter net system 200 that does not require attachment to building protrusions, such as balconies, windows, walls, parapets, or beams.

The support arm 300 rotates in the pivot 800 between an open and closed position. This configuration allows the net 450, which is attached to the support arm 300, to be deployed at various angles. When the support arm 300 rotates, the uplift brace 500 also adjusts and aids in securing the support arm 300 and net 450 in the desired position. The vertical support 900 couples the net system 100 to the building or structure via the back plate 700 and strut 950. The net system braces 600 are also attached to the vertical support 900 and provide added rigidity to the net system 100.

Figure 5:
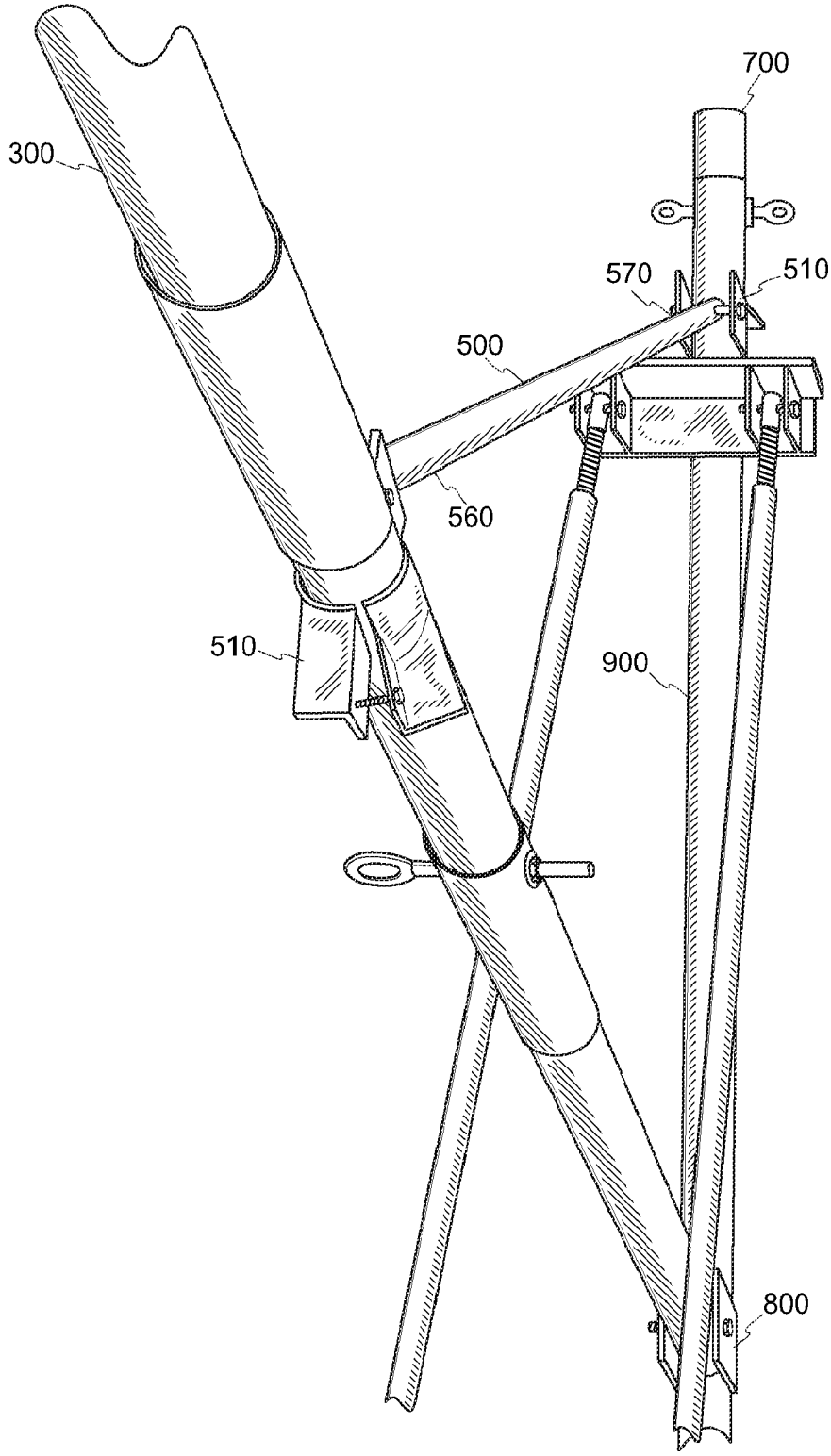
FIG. 5 shows a view of a single free standing perimeter net system with the support arm in the foreground.
Figure 13:
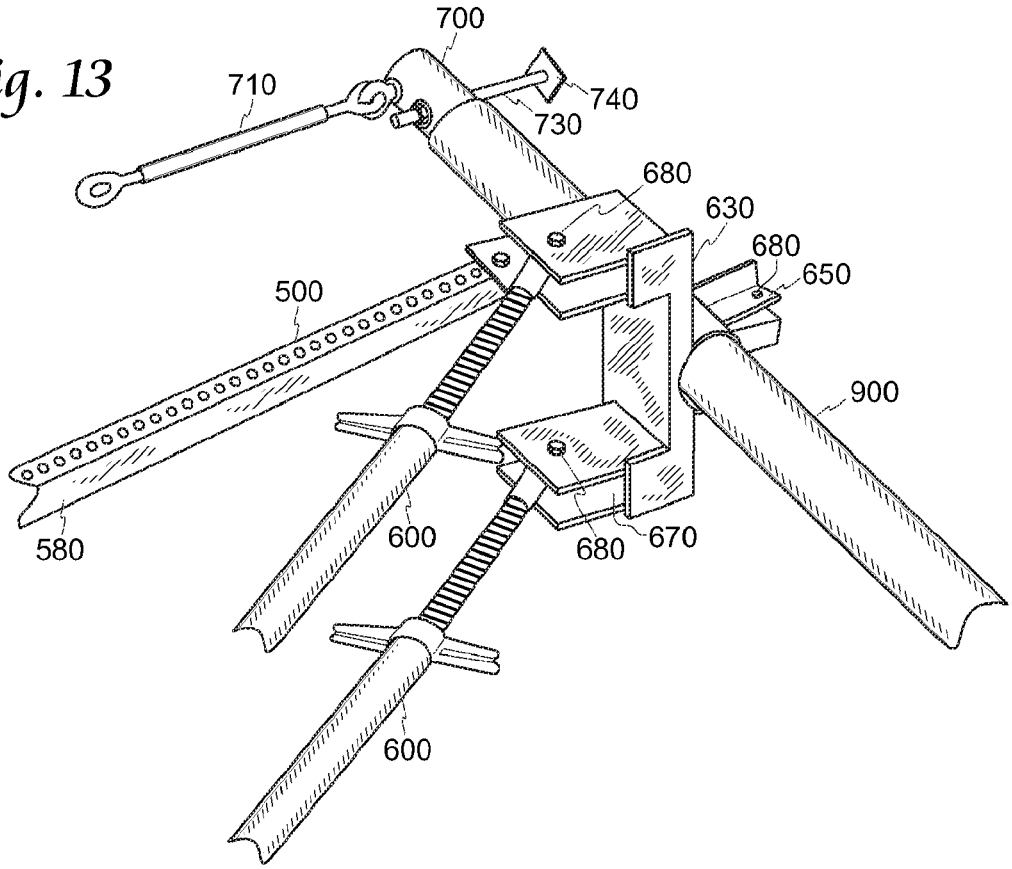
FIG. 13 shows a perspective view of the uplift brace.

As shown in FIG. 5, the support arm 300 is attached to the lower end 560 of the uplift brace 500 and the pivot 800 and, preferably, comes in multiple sections for easy shipping. The upper end 570 of the uplift brace 500 connects to the vertical support 900 just below the back plate 700. The uplift brace 500 provides added support to the support arm 300 when the support arm 300 is in any position between the open 330 and closed positions 340 including the open position 330. As the support arm 300 pivots between the open position 330 and the closed position 340, the uplift brace 500 adjusts. Preferably, the uplift brace 500 is a telescoping pole 580 as shown in FIG. 13. A telescoping pole 580 is a device that comprises two sections. One section of the telescoping pole 580 slides or passes within the other section. This configuration allows the uplift brace 500 to adjust in length as the support arm 300 pivots.

Figure 4:
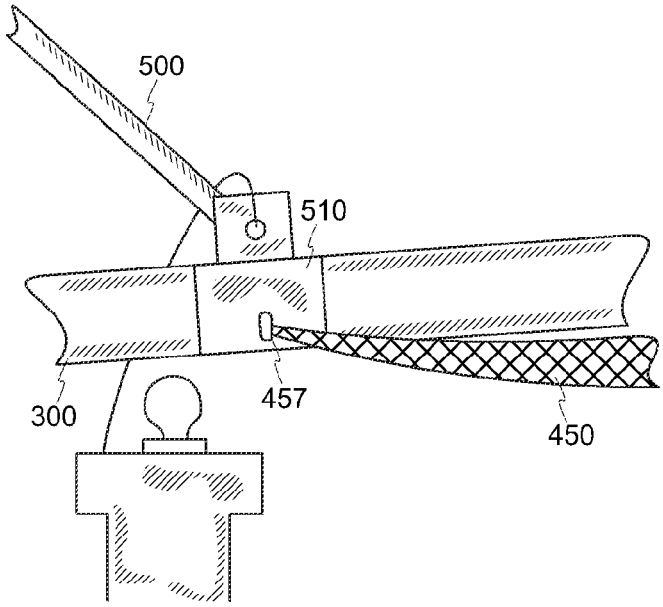
FIG. 4 shows a sectional view of FIG. 2 at the point where the uplift brace connects to the support arm.

In the preferred embodiment, uplift brace brackets 510 connect the uplift brace 500 to the support arm 300 and to the vertical support 900. Additionally, the second side 457 of the net attaches to the uplift brace bracket 510 that is connected to the support arm 300, as shown in FIG. 4. FIG. 2 shows the first side 455 of the net 450 coupled to the first end 310 of the support arm 300, and the net 450 open on the support arm 300.

Figure 6:
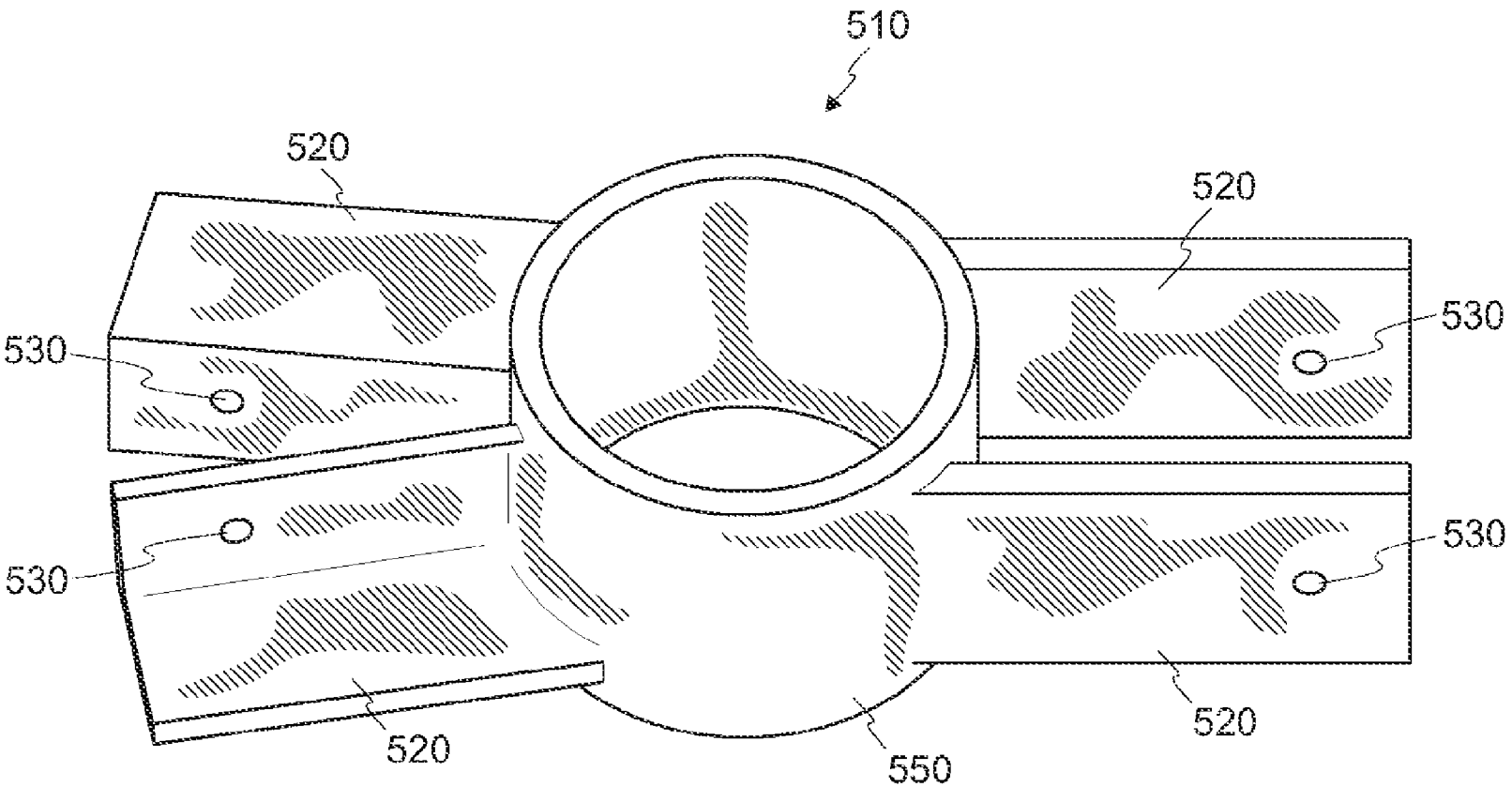
FIG. 6 shows a top view of the uplift brace bracket.
Figure 7:
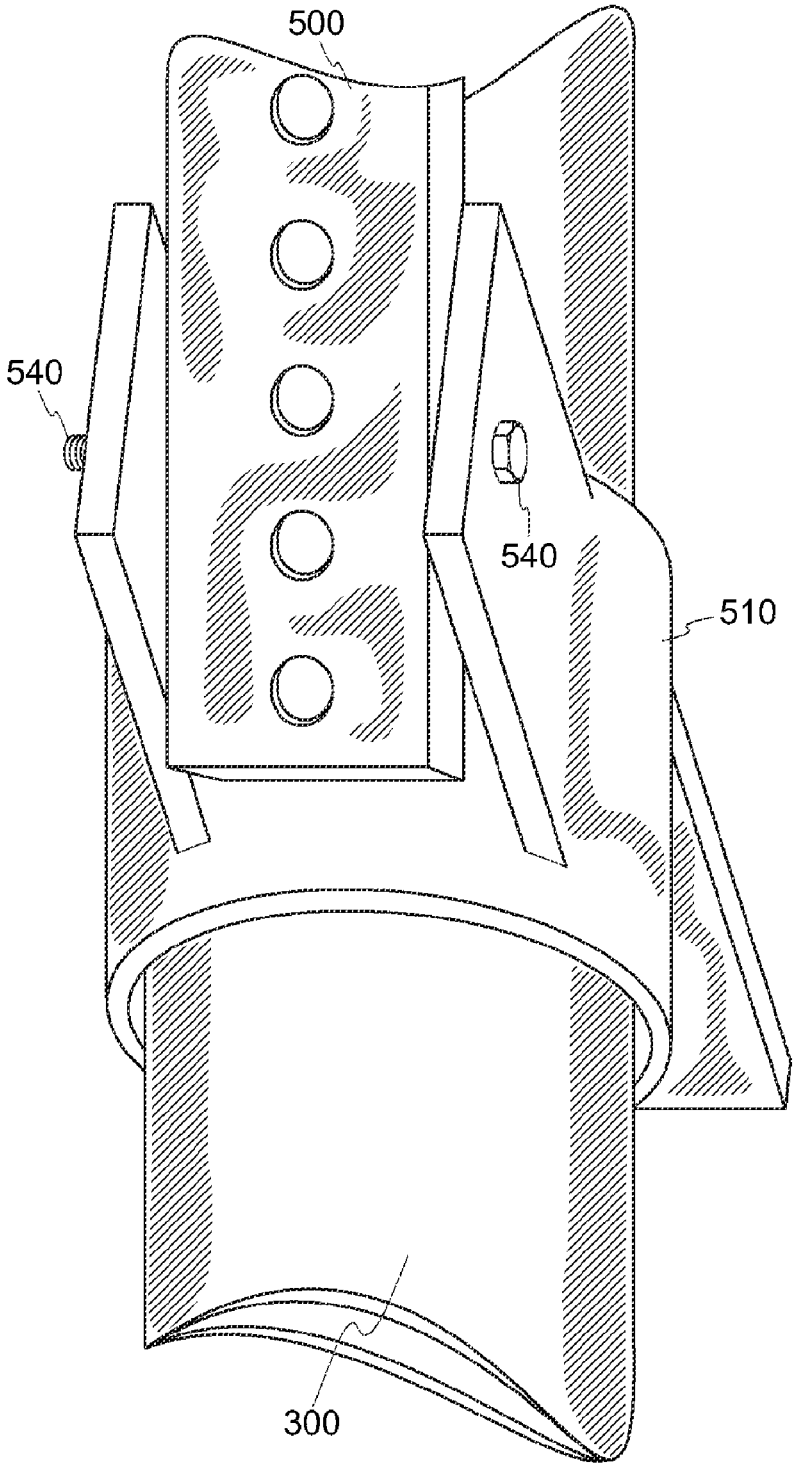
FIG. 7 shows a view of the uplift brace bracket attached to the uplift brace and the support arm.

The uplift brace bracket 510 is in the shape of a cuff 550, and fits tightly around the support arm 300. As illustrated in FIG. 6, the uplift brace bracket 510 has two (2) pair of bracket arms 520 positioned on opposite sides of the cuff 550. Each bracket arm 520 has a hole 530 where a securing member 540 is inserted. One securing member 540 secures the uplift brace bracket 510 to the support arm 300 or the vertical support 900, and the other securing member 540 attaches the uplift brace 500 to the support arm 300 or the vertical support 900. FIG. 7 depicts the uplift brace 500 and uplift brace bracket 510 attached with a securing member 540 that is a bolt. As shown in FIG. 2, one uplift brace bracket 510 is located on the support arm 300 approximately two-thirds (?) of the distance from the first end 310 of the support arm 300 to the second end 320 of the support arm 300. The other uplift brace bracket 510 is located near the top 910 of the vertical support 900.

Figure 8:
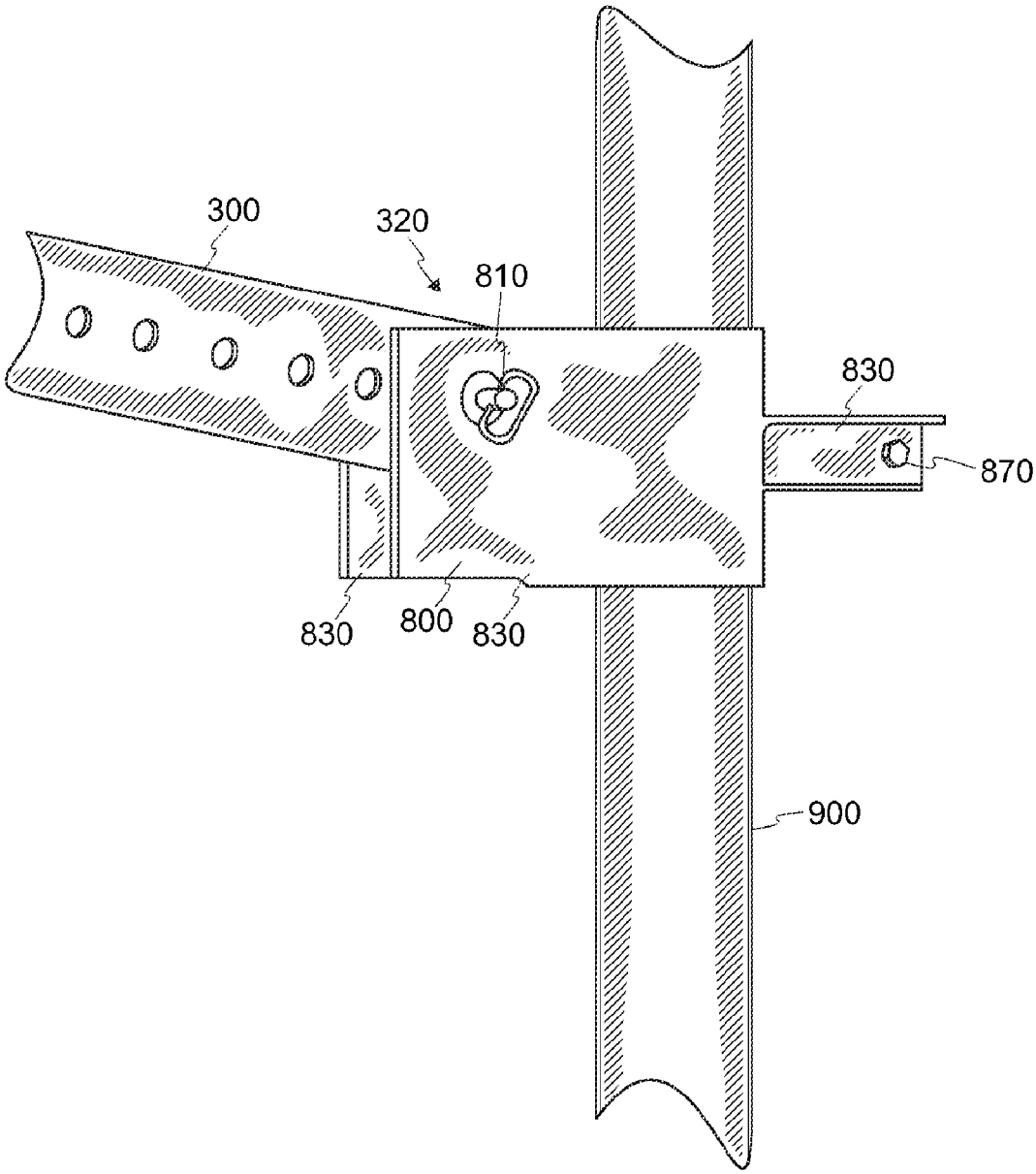
FIG. 8 shows a view of the support arm attached to the pivot with a pivot pin.
Figure 9:
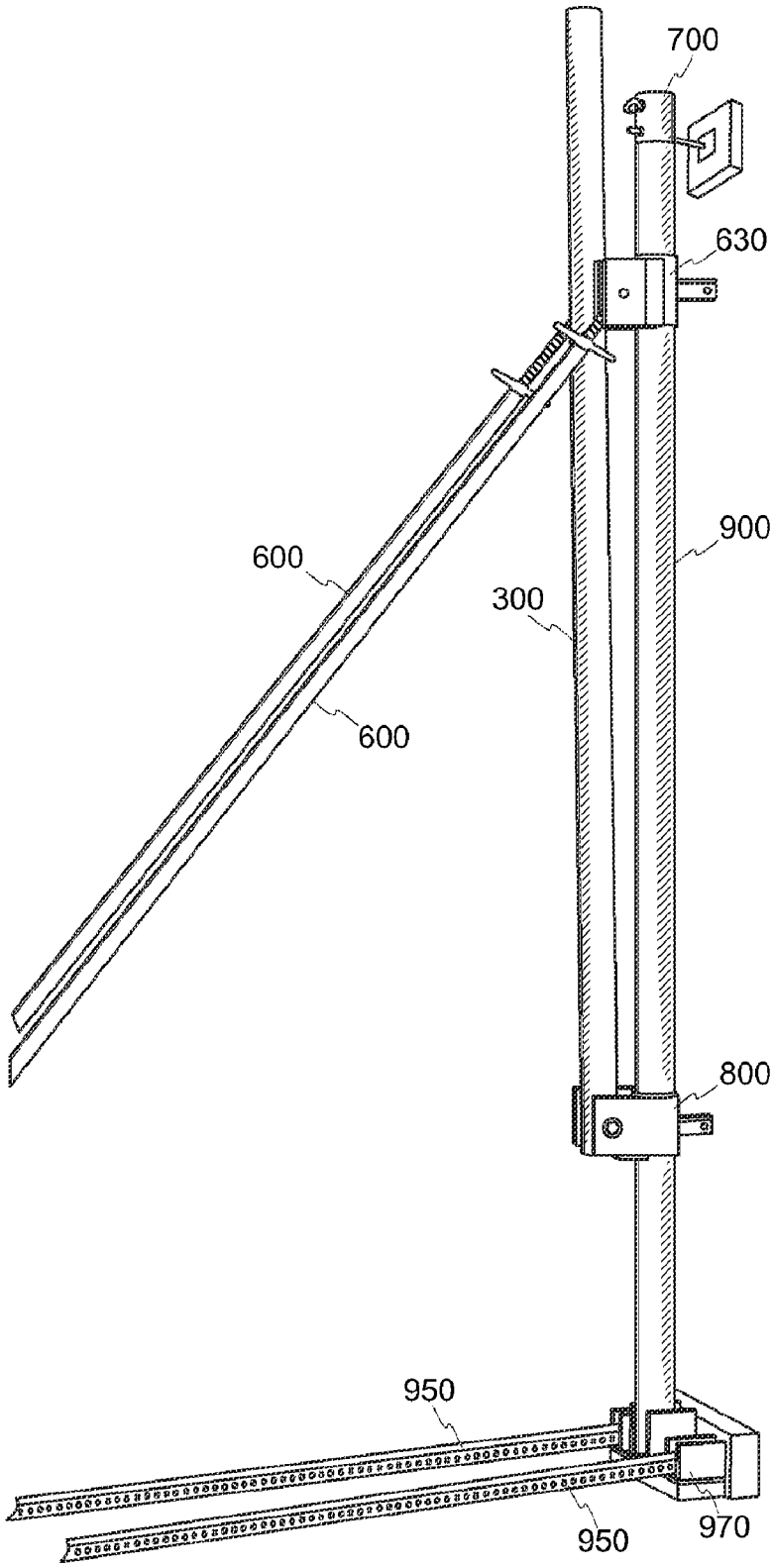
FIG. 9 shows a perspective view of the support arm in the closed position.

The second end 320 of the support arm 300 is attached to the pivot 800 with a pivot pin 810 so that the support arm 300 can rotate, as depicted in FIG. 8. When the support arm 300 is in the open position 330, it is substantially parallel with the ground, shown in FIG. 2; and when the support arm 300 is in the closed position 340, it is substantially parallel with the vertical support 900, shown in FIG. 9.

Figure 10:
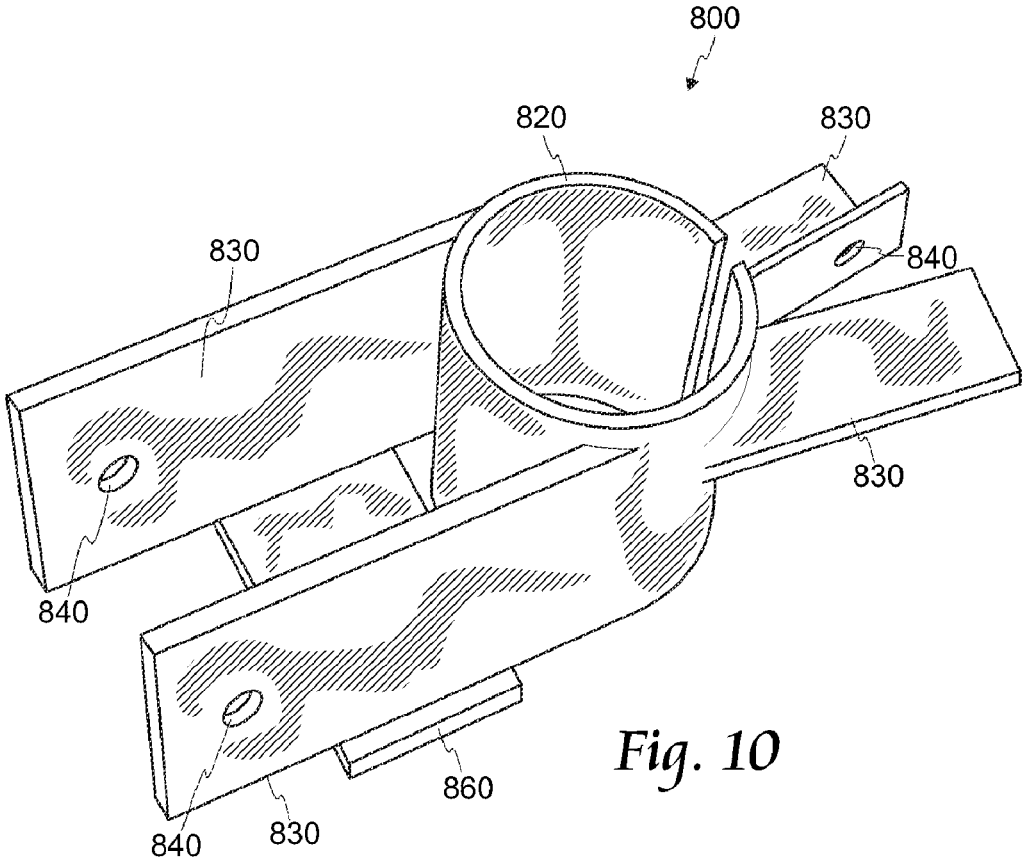
FIG. 10 shows a perspective view of the pivot.

In the preferred embodiment, the pivot 800, as depicted in FIG. 2, is located approximately three-fourths (¾) of the way down the vertical support 900, and takes the shape of a cuff 820 that fits tightly around the vertical support 900. As seen in FIG. 10, the pivot 800 has two (2) pair of bracket arms 830 positioned on opposite sides of the cuff 820. Each bracket arm 830 has a hole 840 where a securing member 850 is inserted. One securing member 850 secures the pivot 800 to the vertical support 900, and the other securing member 850 pivotally attaches to the second end 320 of the support arm 300. Preferably, a bolt 870 attaches the pivot 800 to the vertical support 900, and a pivot pin 810 attaches the second end 320 of the support arm 300 to the vertical support 900 allowing the support arm 300 to rotate around the axis of the pivot pin 810. The pivot 800 also includes a tab 860 that is coupled across the bracket arms 830 that attach the pivot 800 to the support arm 300. The support arm 300 rests on the tab 860 when it is in the open position 330.

Referring again to FIG. 2, a strut 950 and two strut brackets 970 and 960 are shown. The strut 950 is adjustably attached to the first and second strut brackets 960 and 970, and is preferably two telescoping poles 951. The telescoping poles 951 allow the free standing perimeter net system 200 to be adjustable and, therefore, can be secured around various size structures. The second strut bracket 970 attaches to the bottom 920 of the vertical support 900 and the first strut bracket 960 attaches to the bottom 610 of the net system braces 600.

Figure 11:
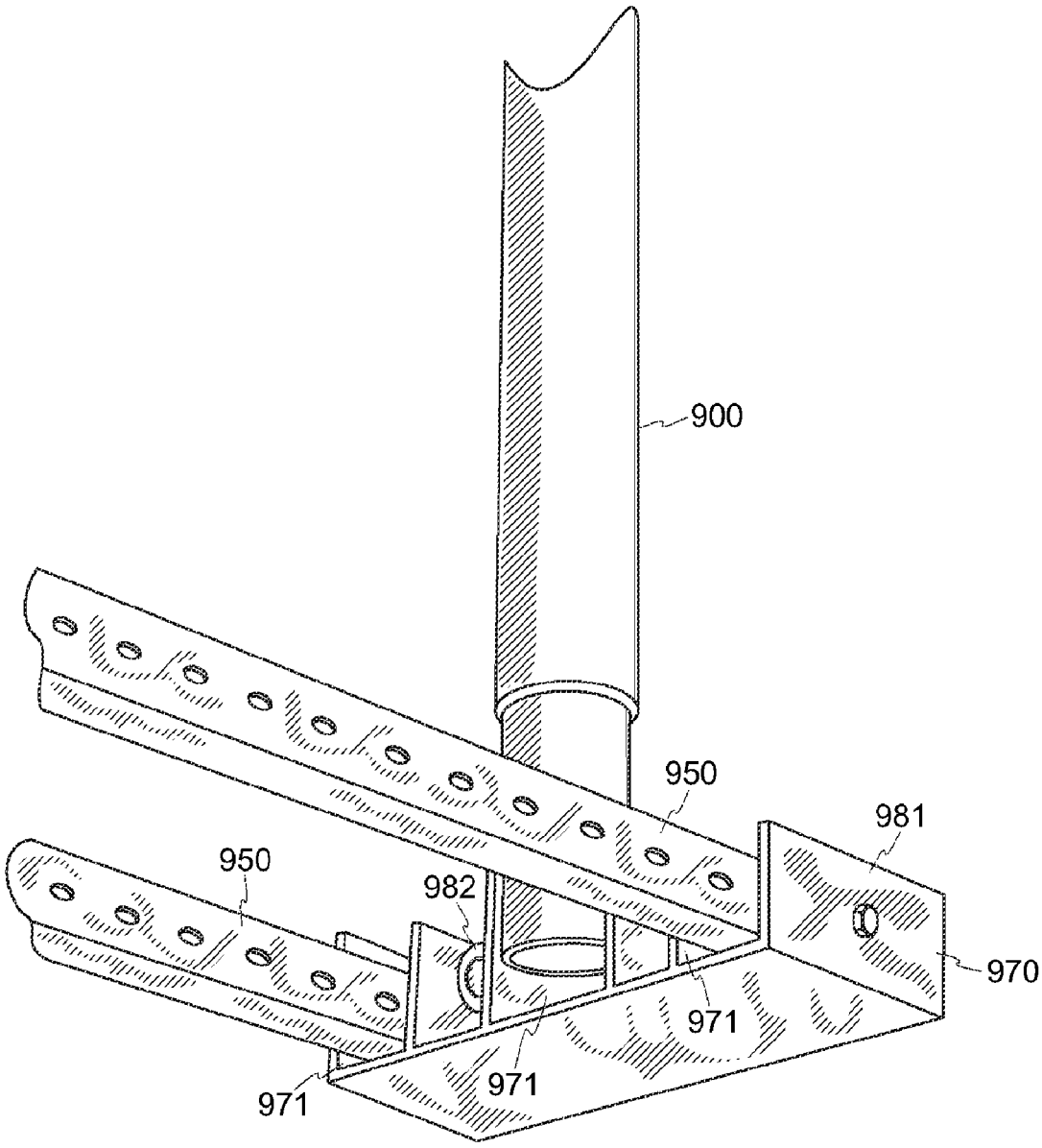
FIG. 11 shows a perspective view of the second strut bracket and the strut.
Figure 17:
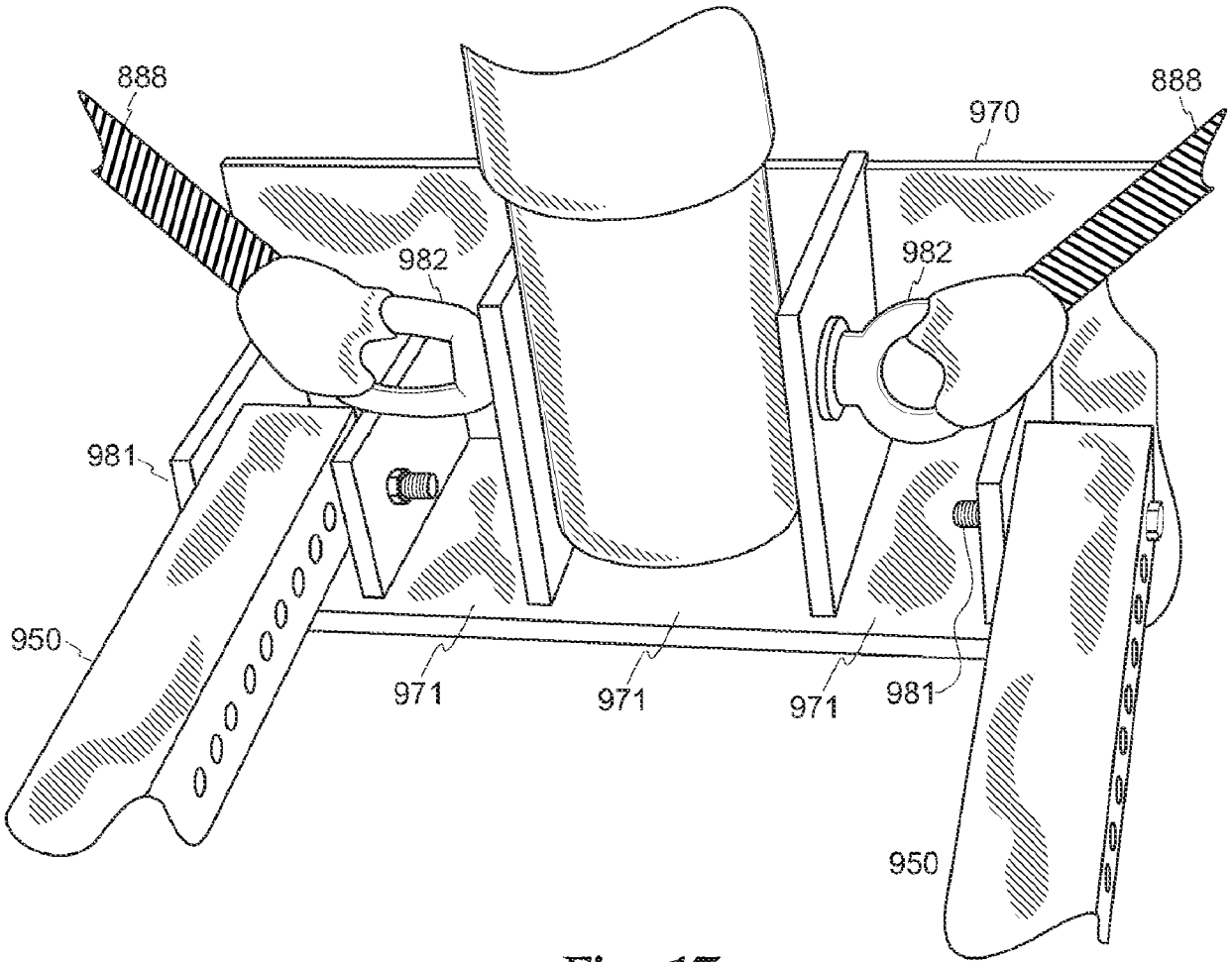
FIG. 17 shows a view of the second strut bracket and the vertical support with tie cables to attach multiple free standing perimeter net systems.

FIG. 11 shows the second strut bracket 970 attached to the vertical support 900 and the strut 950. In the preferred embodiment, the second strut bracket 970 includes three slots 971. The vertical support 900 is inserted in the middle slot 971, and the two telescoping poles 951 that make up the strut 950 are inserted into the outer two slots 971. The telescoping poles 951 adjust in length to allow the free standing perimeter net system 200 to be secured around various size structures. The vertical support 900 and the two telescoping poles 951 are fastened to the second strut bracket 970 with securing members 980. Preferably, the telescoping poles 951 are connected in the slots 971 with bolts 981, and the vertical support 900 is coupled in the slot 971 with an eyebolt 982 shown in FIG. 17. Also attached to the eyebolt 982 are tie cables 888 which allow the free standing perimeter net system 200 to connect to enclose a perimeter of a structure 110 as shown in FIG. 1.

Figure 12:
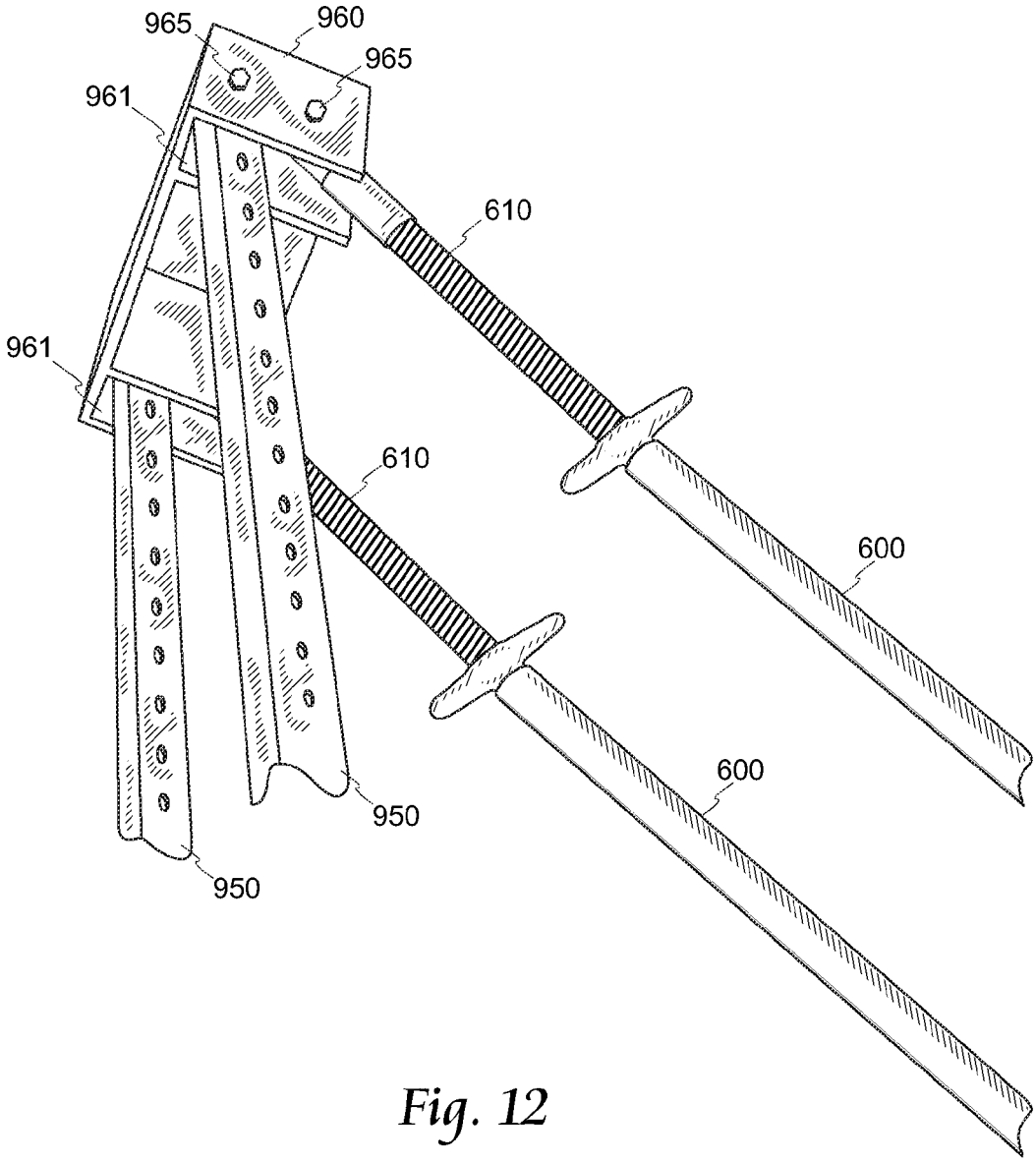
FIG. 12 shows a perspective view of the first strut bracket and the strut.

The first strut bracket 960 attaches to the bottom 610 of the net system braces 600 and the strut 950 as illustrated in FIG. 12. Preferably, the first strut bracket 960 has two slots 961. The telescoping poles 951 and the bottoms 610 of the net system braces 600 are inserted into the two slots 961. In the preferred embodiment, the net system braces 600 are positioned above the telescoping poles 951, and all are fastened to the first strut bracket 960 with bolts 965.

As described above, the tops 620 of the net system braces 600 are attached to the vertical support 900 and the bottoms 610 of the net system braces are attached to the first strut bracket 960 as shown in FIG. 2. The net system braces 600 add support and maintain the rigidity of the free standing perimeter net system 200 when the support arm 300 and net 450 are in position to protect people and objects from falling.

Figure 14:
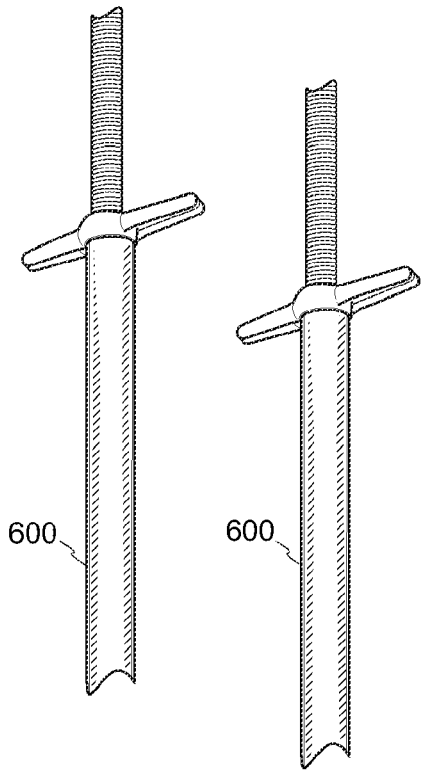
FIG. 14 shows a perspective view of the net system brace.
Figure 18:
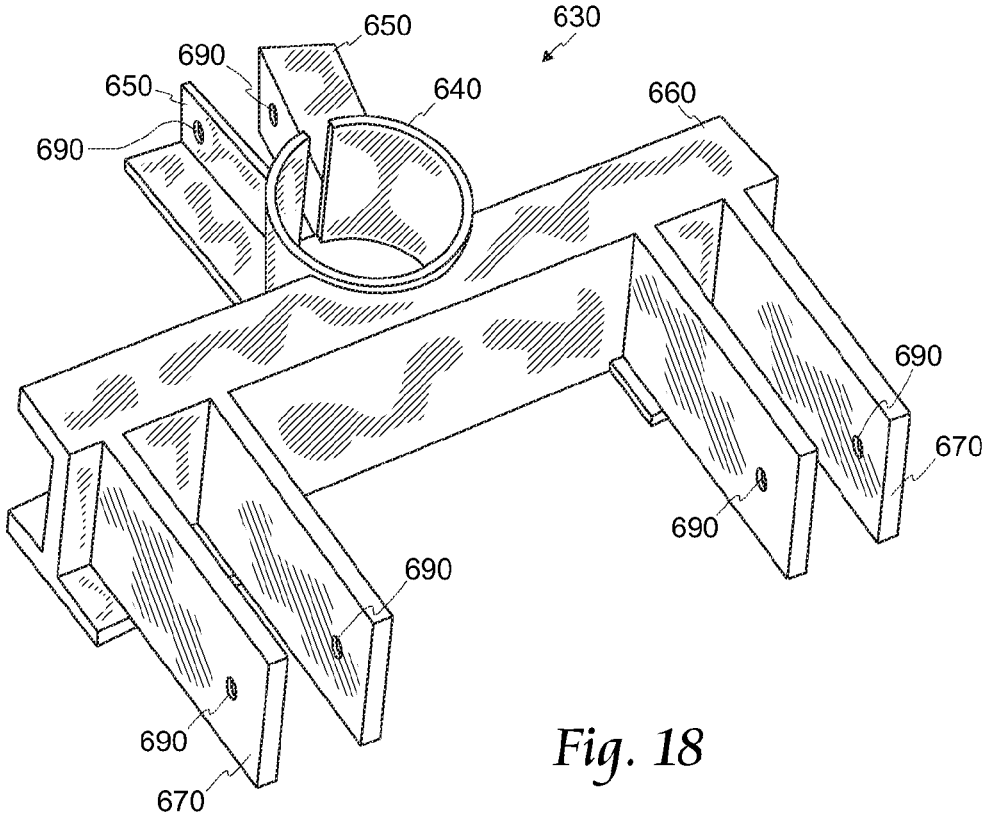
FIG. 18 shows a top view of the net system brace bracket.
Figure 19:
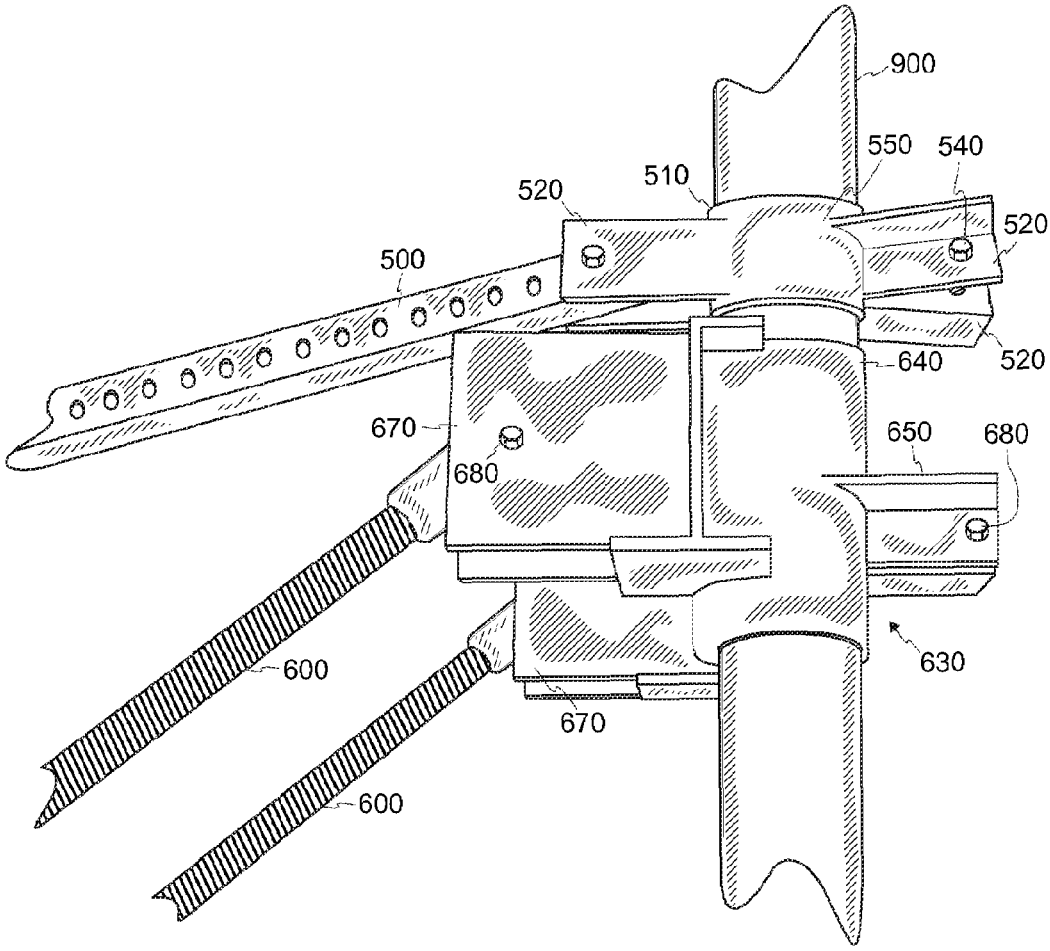
FIG. 19 shows a side view of the net system braces and the uplift brace attached to the vertical support with a net system brace bracket and an uplift brace bracket.

As depicted in FIG. 14, the net system braces 600 are adjustable to allow the free standing perimeter net system 200 to secure around various size structures. FIG. 18 illustrates the net system brace bracket 630 that attaches the tops 620 of the net system braces 600 to the vertical support 900. The net system brace bracket 630 is comprised of a cuff 640, a pair of bracket arms 650, a support brace 660, and a pair of brace slots 670. The cuff 640 fits around the vertical support 900 and is secured by placing a securing member 680, preferably a bolt, through the holes 690 on the bracket arms 650. There are also holes 690 on the brace slots 670 where securing members 680, preferably bolts, secure the net system braces 600 to the brace slots 670. FIG. 19 illustrates the preferred configuration of the uplift brace bracket 510 and the net system brace bracket 630 on the vertical support 900.

Figure 15:
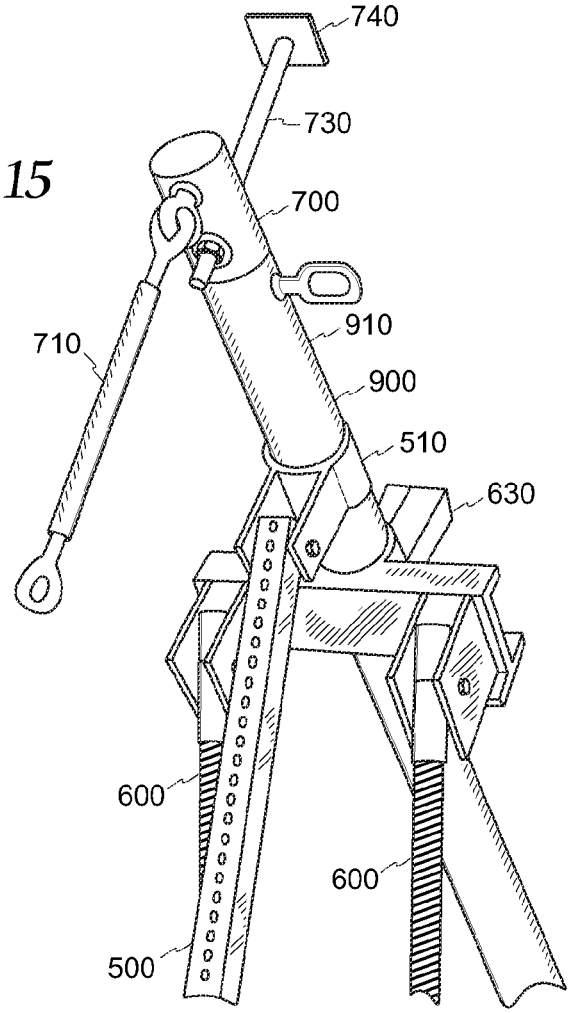
FIG. 15 shows a perspective view of the back plate.

The support cable 400 shown in FIG. 2 also provides added support to the support arm 300. The first side 410 of the support cable 400 is attached to the first end 310 of the support arm 300, and the second end 420 of the support cable 400 is attached to the back plate 700. Preferably, the support cable 400 attaches to the support arm 300 with an eyebolt 430, as depicted in FIG. 2, and to the back plate 700 with a turnbuckle 710, as shown in FIG. 15. The turnbuckle 710 is used to aid in maintaining the tautness of the support cable 400. As the support cable 400 becomes loose, the turnbuckle 710 is tightened to add tension to the support cable 400. The turnbuckle 710 allows the support cable 400 to be easily tightened without disconnecting it from the support arm 300 or the back plate 700.

Figure 16:
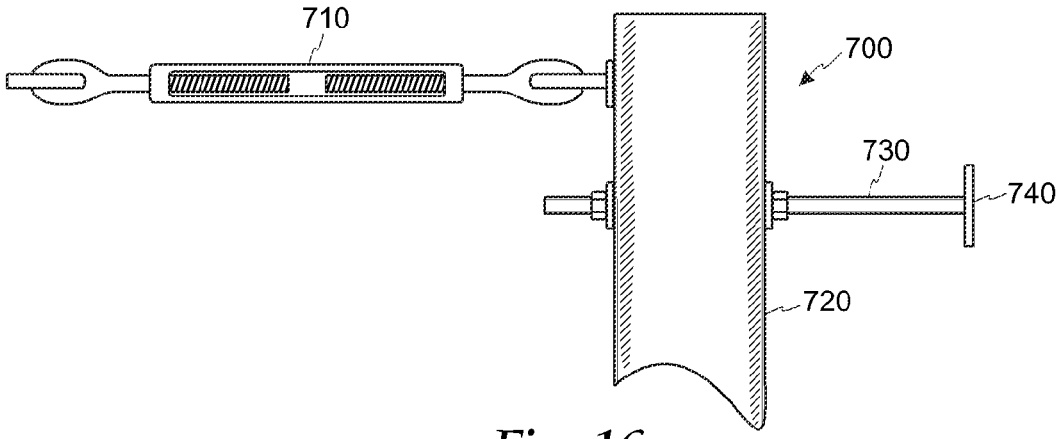
FIG. 16 shows a view of the back plate with the separate pieces detached.

As illustrated in FIG. 2, the back plate 700 is coupled to the top 910 of the vertical support 900. The back plate 700 comprises a tube 720 that is coupled to the top 910 of the vertical support 900, a turnbuckle 710, and an extension rod 730 with a flat plate 740 shown in FIG. 16. As described above, the turnbuckle 710 attaches to the support cable 400 to aid in increasing the tautness of the support cable 400. The extension rod 720 and the attached flat plate 740 ensure that the free standing perimeter net system 200 is secured against the structure. The flat plate 740 is fastened to the structure with a securing means such as a bolt. In an alternate embodiment, the flat plate 740 is fastened to a piece of wood or similar item that is a buffer between the flat plate 740 and the structure.

The preferred embodiment of the invention is described above, in the Drawings, and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A free standing perimeter net system comprising:

a support arm, said support arm further comprising:

a first end; and a second end;

a support cable, said support cable further comprising:

a first side; and
a second side;
an uplift brace, said uplift brace further comprising:
an upper end; and
a lower end;
at least one net system brace, said at least one net system brace further comprising:
a top; and
a bottom;
a pivot;
a back plate;
a vertical support, said vertical support further comprising:
a top; and
a bottom;
a strut;
a net, said net further comprising:
a first side; and
a second side;
a first strut bracket;
a second strut bracket;
said first side of said net is coupled to said first end of said support arm and said second side of said net is coupled along the length of said uplift brace bracket;
said second end of said support arm is coupled to said pivot wherein said pivot is coupled along the length of said vertical support some distance below said net system brace such that said support arm rotates between an open position and a closed position wherein when said support arm is in said open position, said net is open;
said upper end of said uplift brace is coupled along the length of said vertical support and said lower end of said uplift brace is coupled along the length of said support arm wherein said uplift brace adjusts as said support arm rotates between said open and closed positions such that said uplift brace supports said support arm in any position between said open and closed positions;
said first side of said support cable is coupled to said first end of said support arm and said second side of said support cable is coupled to said back plate such that said support cable secures said support arm in said open position;
said top of said net system brace is coupled along the length of said vertical support some distance below said uplift brace and said bottom of said net system brace is coupled to said first strut bracket such that said net system brace secures said free standing perimeter net system;
said top of said vertical support is coupled to said back plate such that said back plate is capable of coupling said vertical support to a building and said bottom of said vertical support is coupled to said second strut bracket; and
said strut is adjustably coupled to said first strut bracket and said second strut bracket such that said strut supports said free standing perimeter net system.

2. The net system of claim 1 wherein said support arm is coupled to said pivot by a pivot pin.

3. The net system of claim 1 wherein:
said support cable is coupled to said support arm with an eyebolt; and
said support cable is coupled to said back plate with a turnbuckle such that said
support cable can be tightened with said turnbuckle.

4. The net system of claim 3 wherein:
said uplift brace is coupled to said vertical support by an uplift brace bracket; and
said uplift brace is coupled to said support arm by an uplift brace bracket.

5. The net system of claim 4 wherein said uplift brace is coupled to said uplift brace brackets with at least one bolt.

6. The net system of claim 5 wherein said uplift brace is a telescope pole such that said uplift brace adjusts as said support arm rotates into aid open position or said closed position.

7. The net system of claim 1 wherein said net system comprises a plurality of net system braces.

8. The net system of claim 7 wherein said net system braces are coupled to said vertical support with at least one net system brace brackets.

9. The net system of claim 1 wherein said pivot is coupled along the length of said vertical support such that said support arm releases into said open position.

10. The net system of claim 1 wherein said strut is at least one telescope pole.

* * * * *